US006694109B1

(12) United States Patent
Donaldson et al.

(10) Patent No.: US 6,694,109 B1
(45) Date of Patent: Feb. 17, 2004

(54) REAL-TIME CONTROL OF TONE REPRODUCTION CURVE BY REDEFINITION OF LOOKUP TABLES FROM FIT OF IN-LINE ENHANCED TONER AREA COVERAGE (ETAC) DATA

(75) Inventors: Patricia J. Donaldson, Pittsford, NY (US); Thomas F. Shane, Seneca Falls, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/342,557

(22) Filed: Jan. 15, 2003

(51) Int. Cl.[7] ..... G03G 15/00
(52) U.S. Cl. ..... 399/49; 347/131
(58) Field of Search ..... 399/49, 38, 39; 347/131, 251; 358/3.01, 300

(56) References Cited

U.S. PATENT DOCUMENTS 5,612,902 A 3/1997 Stokes et al.
5,649,073 A 7/1997 Knox et al.
5,710,958 A * 1/1998 Raj ..... 399/49
5,749,020 A 5/1998 Mestha et al.
5,777,656 A 7/1998 Henderson
5,963,244 A 10/1999 Mestha et al.
6,035,152 A 3/2000 Craig et al.
2003/0086717 A1 * 5/2003 Shim et al. ..... 399/49
2003/0147660 A1 * 8/2003 Shim et al. ..... 399/49

* cited by examiner

*Primary Examiner*—Joan Pendegrass
(74) *Attorney, Agent, or Firm*—Fay, Sharpe, Fagan, Minnich & McKee, LLP

(57) ABSTRACT

A method and system having real-time control of tone reproduction curves. The machine comprises: a moving photoreceptor; a means for storing a target tone reproduction curve; and, a means for updating a current tone reproduction curve LUT. The means for updating comprises a means for scheduling the depositing and measuring of the test patches; a means for depositing halftone test patches on the photoreceptor; a means for measuring the density of the halftone test patches and generating a measured tone reproduction curve; a means for computing differences between the measured tone reproduction curve and the target tone reproduction curve; a means for fitting the differences to a mathematical function; a means for calculating a new tone reproduction curve LUT based on the target tone reproduction curve and the fitted differences, including a means for limiting differences between the new tone reproduction curve LUT and a current tone reproduction curve LUT to a predetermined maximum magnitude; and a means for loading the current tone reproduction curve LUT with the new tone reproduction curve LUT.

18 Claims, 6 Drawing Sheets

REAL-TIME CONTROL OF TONE REPRODUCTION CURVE BY REDEFINITION OF LOOKUP TABLES FROM FIT OF IN-LINE ENHANCED TONER AREA COVERAGE (ETAC) DATA

BACKGROUND OF THE INVENTION

The invention relates to xerographic process control and, more particularly, to the improvement for measurement and adjustment of tone reproduction curves by using real-time control of the tone reproduction curve by redefinition of look tables from fitting of in-line enhanced toner area coverage sensor data.

In copying or printing systems such as a xerographic copier, laser printer or inkjet printer, a common technique for monitoring the quality of prints is to artificially create a test patch of a predetermined desired density. The actual density of the printing material, toner or ink for example, in the test patch can then be optically measured to determine the effectiveness of the printing process in placing this printing material on the print sheet.

In the case of xerographic devices such as a laser printer, the surface that is typically of most interest in determining the density of printing material thereon is the charge retentive surface or photoreceptor on which the electrostatic latent image is formed and subsequently developed by causing toner particles to adhere to areas thereof that are charged in a particular way. In such a case, an optical device, often referred to as a densitometer, for determining the density of toner on the test patch is disposed along the path of the photoreceptor directly downstream of the development unit. There is typically a process within the operating system of the printer to periodically create test patches of the desired density at predetermined locations on the photoreceptor by deliberately causing the exposure system thereof to change or discharge as necessary the surface at the location to a predetermined extent.

The test patch is then moved past the developer unit and the toner particles within the developer unit are caused to adhere to the test patch electrostatically. The denser the toner on the test patch, the darker the test patch will appear in optical testing. The developed test patch is moved past a densitometer disposed along the path of the photoreceptor and the light absorption of the test patch is tested. The density of toner on the patch varies in direct relationship to the percentage of light absorbed by the test patch.

Xerographic test patches that are used to measure the deposition of toner on paper to measure and control the tone reproduction curve (TRC) are traditionally printed on inter-document zones of the photoreceptor belts or drums. Generally, each patch is a small square that is printed as a uniform solid halftone or background area. This practice enables the sensor to read values on the TRC for each test patch.

Many xerographic printing system process controls move physical actuators such as developer bias, charge level and raster output scanner (ROS) intensity to maintain the TRC as measured by an in-line enhanced toner area coverage (ETAC) sensor. The controls maintain the TRC at 3 points, however, there is still some variation at the control points due to dead band control, and there is still some variation between the control points due to changes in the shape of the TRC. There are insufficient actuators and insufficient latitude to control the entire TRC to the desired accuracy. This variation causes objectionable changes, especially in overlay colors which are printed using more than one of the printer primary colors.

Accordingly, because of the difficulty in monitoring and controlling the toner development process, various approaches have been hereinbefore devised.

U.S. Pat. No. 5,963,244 to Mestha et al. discloses the idea of sensing the TRC at discrete intervals and doing a least squares fit to project an entire TRC. The tone reproduction curve is recreated by providing a look-up table for reconstruction of the TRC. The look-up table incorporates a co-variance matrix of elements containing end-tone reproduction samples. The matrix multiplier responds to sensed developed patch samples and to the look-up table to reproduce a complete tone reproduction curve. A control reacts to the reproduced tone reproduction curve to adjust machine quality.

U.S. Pat. No. 5,749,020 to Mestha et al. discloses the idea of describing TRC variations using a set of orthogonal basis functions. The basis functions are derived by decomposing sample tone reproduction curves to provide a predicted tone reproduction curve. The predicted tone reproduction curve is melded with a discrete number of tone reproduction samples to produce a reconstructed TRC for machine control.

U.S. Pat. No. 6,035,152 to Craig et al. discloses a method for measurement of tone reproduction curves. A setup calibration TRC is generated based on preset representative halftone patches. A test pattern comprising a plurality of halftone patches is marked in the inter-document zone of the imaging surface. A relative reflection of each of the halftone patches is entered into a matrix and the matrix is correlated to a plurality of print quality actuators. A representative TRC is generated based on the matrix results. A feedback signal is produced by comparing the representative TRC to the setup calibration tone curve and each of the print quality actuators is adjusted independently to adjust printing machine operation for print quality correction.

U.S. Patent No. 5,777,656 to Henderson describes the concept of using lookup tables to adjust a measured TRC to match a target TRC. The method of maintaining tone reproduction for printing comprises the steps of marking representative halftone targets on an imageable surface with toner sensing an amount of toner on each of the representative halftone targets, generating a representative TRC based on the sensed amount of toner on the representative halftone targets, producing a feedback signal generated by comparing a representative TRC to a setup calibration tone curve and adjusting pixel data of each pixel of the final halftone image to compensate for deviation between the representative TRC and the setup calibration tone curve.

U.S. Pat. No. 5,649,073 to Knox et al. discloses a method and apparatus for calibrating gray reproduction schemes for use in a printer. The calibration system includes a test pattern stored in a memory and providing a plurality of samples of combinations of printed spots printable on a media by the printer. A gray measuring device is included to derive a gray measurement of the samples of printed spots. A calibration processor correlates the gray measurements with a combination of spots having a particular spatial relationship and derives parameters describing the printer response to the combination. The calibration processor generates from the derived parameters at least one non-linear gray image correction function then stores the generated gray image function calibration in a calibration memory. A means is provided to apply the gray image correction stored in the calibration memory to calibrate a printer using a halftone pattern.

U.S. Pat. No. 5,612,902 issued to Stokes discloses a method and system for automatic characterization of a color printer. A relatively few number of test samples are printed and measured to create an analytic model which characterizes a printer. The analytical model is used in turn to generate a multi-dimensional look-up table that can then be used at one time to compensate image input and create a desired visual characteristic in the printed image.

Accordingly, it is an object of the present invention to provide a new and improved method for process control by providing real-time adjustment to a target TRC by means of real-time update of machine look-up tables.

SUMMARY OF THE INVENTION

A method and system are provided for real-time control of tone reproduction curves. The machine comprises a moving photoreceptor, a means for storing a target tone reproduction curve and a means for updating a current tone reproduction curve look-up table (LUT). The means for updating a current tone reproduction curve LUT comprises a means for scheduling the depositing and measuring of the test patches, a means for depositing halftone test patches on the photoreceptor, a means for measuring the density of the halftone test patches and generating a measured tone reproduction curve, a means for computing differences between the measured tone reproduction curve and the target tone reproduction curve and fitting the differences to a three parameter sine function, a means for calculating a new tone reproduction curve LUT based on the target tone reproduction curve and the fitted differences, a means for limiting differences between the new tone reproduction curve LUT and a current tone reproduction curve LUT to a predetermined maximum magnitude, and a means for loading the current tone reproduction curve LUT with the new tone reproduction curve LUT.

DETAILED DESCRIPTION OF THE PREFERRED EMBODIMENT

It will become evident from the following discussion that embodiments of the present application set forth herein, are suited for use in a wide variety of printing and copying systems, and are not necessarily limited in application to the particular systems illustrated.

Figure 1:
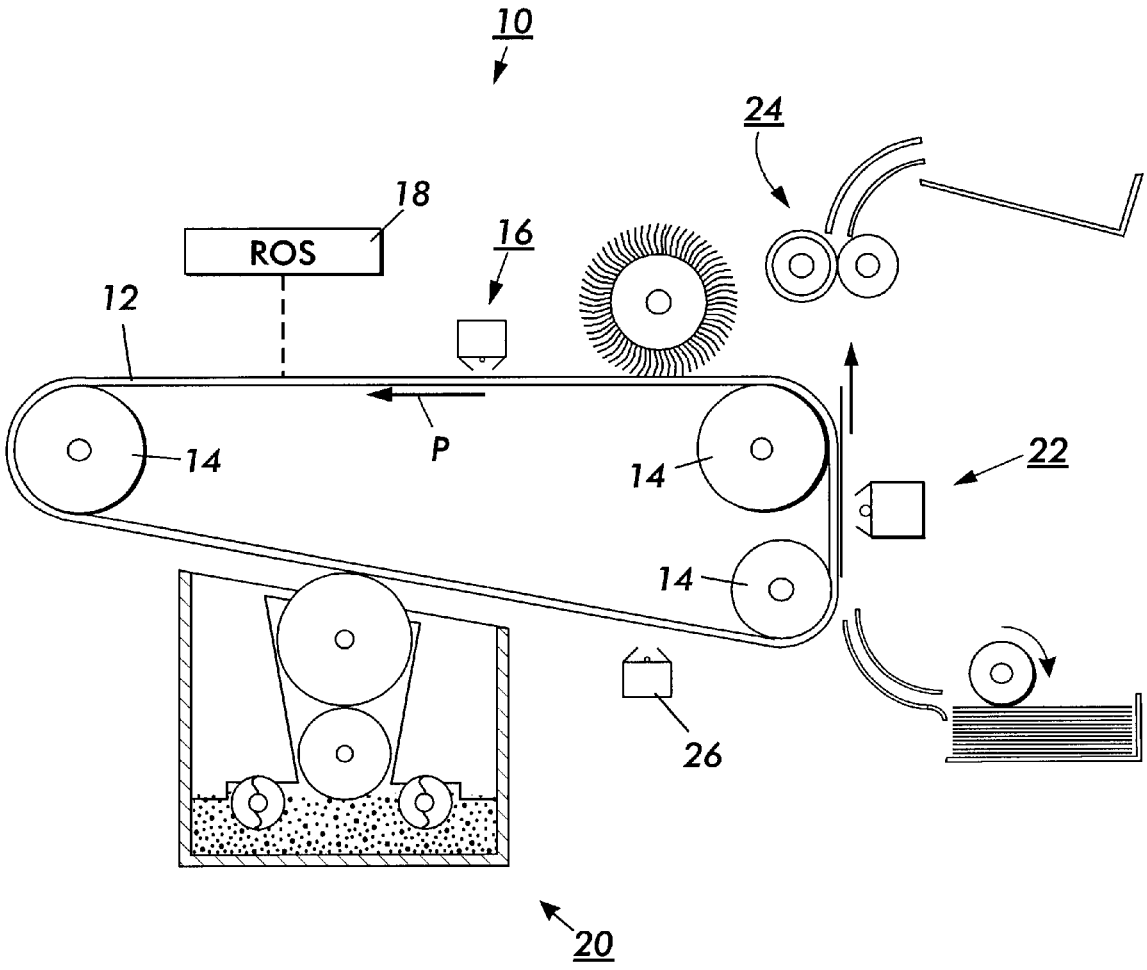
FIG. 1 is an illustration of an electrophotographic machine incorporating tone reproduction curve control in accordance with the present invention.

FIG. 1 is a schematic representation of a well-known system suitable for incorporating embodiments of the present invention. Included within printing electrophotographic system 10 is a photoreceptor 12 which may be in the form of a belt or drum and which comprises a charge retention surface. In this embodiment, photoreceptor 12 is entrained on a set of rollers 14 and caused to move in a counter-clockwise process direction by means such as a motor (not shown).

The first step in an electrophotographic process is the charging of the relevant photoreceptor surface. This initial charging is performed by charge source 16. The charged portions of the photoreceptor 12 are then selectively discharged in a configuration corresponding to the desired image to be printed by a raster output scanner (ROS) 18. ROS 18 generally comprises a laser source (not shown) and a rotatable mirror (also not shown) acting together in a manner known in the art to discharge certain areas of the charged photoreceptor 12. Although a laser source is shown in the exemplary embodiment, other systems that can be used for this purpose include, for example, an LED bar or a light lens system. The laser source is modulated in accordance with digital image data fed into it and the rotating mirror causes the modulated beam from the laser source to move in a fast scan direction perpendicular to the process direction of the photoreceptor 12. The laser source outputs a laser beam of sufficient power to charge or discharge the exposed surface on photoreceptor 12 in accordance with a specific machine design.

After selected areas of the photoreceptor 12 are discharged by the laser source, remaining charged areas are developed by developer unit 20 causing a supply of dry toner to contact the surface of photoreceptor 12. The developed image is then advanced by the motion of photoreceptor 12 to a transfer station including a transfer device 22, causing the toner adhering to the photoreceptor 12 to be electrically transferred to a substrate, which is typically a sheet of paper, to form the image thereon. The sheet of paper with the toner image thereon is then passed through a fuser 24, causing the toner to melt or fuse into the sheet of paper to create a permanent image.

One way in which print quality can be quantified is by measurement of the halftone area density, (i.e., the copy quality of a representative area), which is intended to be, for example, fifty percent (50%) covered with toner. The halftone is typically created by virtue of a dot screen of a particular resolution and, although the nature of such a screen will have a great effect on the absolute appearance of the halftone, any common halftone may be used. Both the solid area and halftone density may be readily measured by optical sensing systems that are familiar in the art.

As shown, densitometer 26 is used after the developing step to measure the optical density of the halftone density test patch created on the photoreceptor 12 in a manner known in the art. As used herein, the work "densitometer" is intended to apply to any device for determining the density of print material on a surface, such as a visible light densitometer, an infrared densitometer, an electrostatic volt meter, or any other such device which makes a physical measurement from which the density of print material may be determined.

Figure 2:
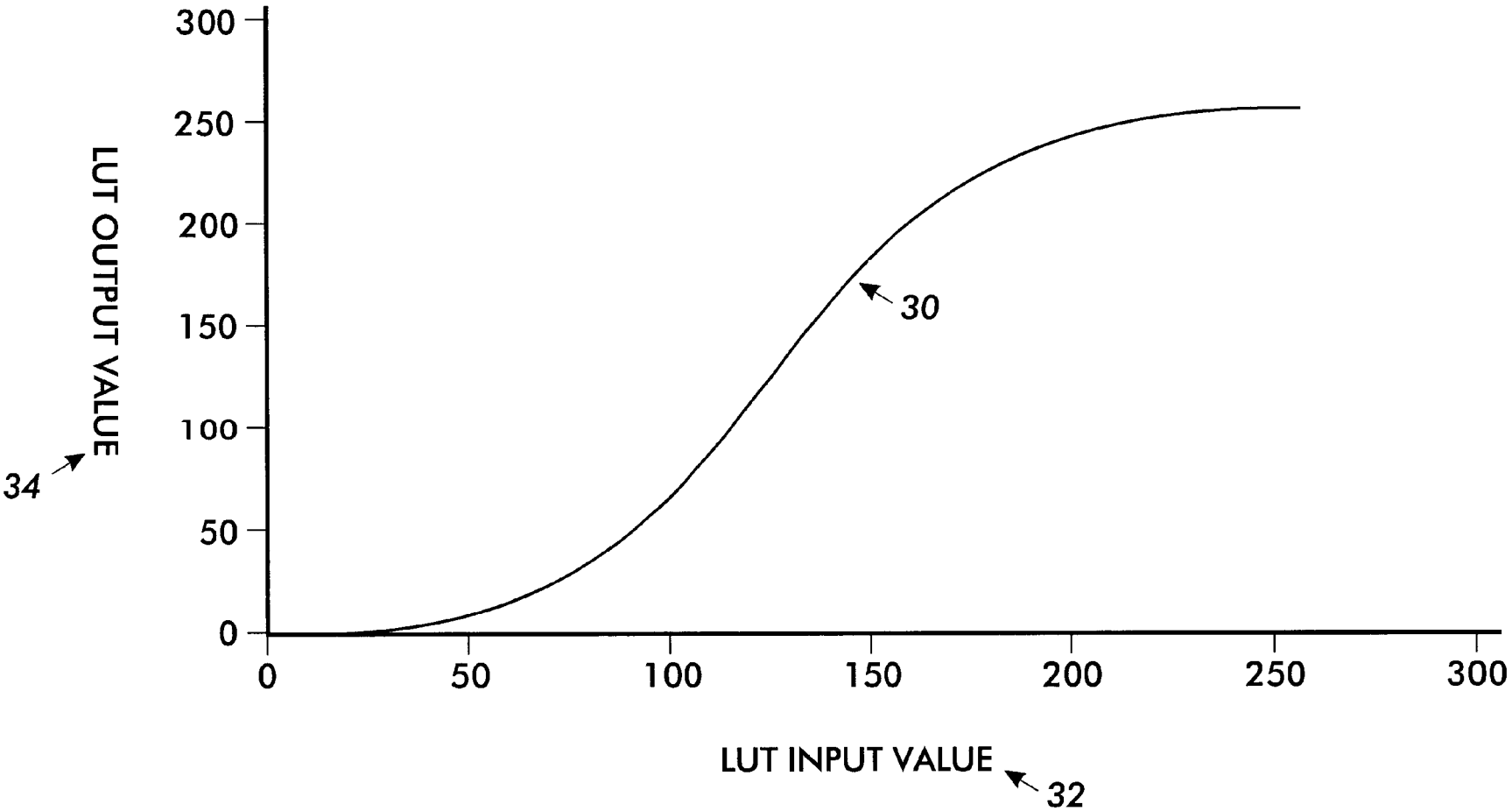
FIG. 2 is a visualization of a TRC lookup table (LUT)

Typically, when the laser source causes spots of a certain size to be deposited, the spots become somewhat enlarged when developed. Theoretically, if the spots were able to be developed at exactly the same size as the deposited spots, then perfect size reproduction would be possible, wherein the TRC would be a straight line. However, because of the undesirable spot enlargement, the TRC takes on the form of a curve, one example of which is shown in FIG. 2, in order to produce the desired output density. In order to maintain a TRC at its desired configuration, voltage levels within printing system 10 can be changed in order to produce a desirable TRC. For example, mag bias, charge level and laser power can be modified in order to maintain the desired curve.

FIG. 2 provides a visual representation of a TRC 30 implemented in the form of an LUT. In this exemplary implementation, an input C, M, Y or K value is found on the horizontal LUT input value axis 32. A vertical line from the determined position on the horizontal axis intersects the TRC curve 30 at a point that determines the LUT output value 34 in terms of C, M, Y or K as read from the vertical axis. Utilizing the afore-mentioned controls for mag bias, charge level and laser power to stabilize the TRC provides reasonable results but with some variation.

Figure 3:
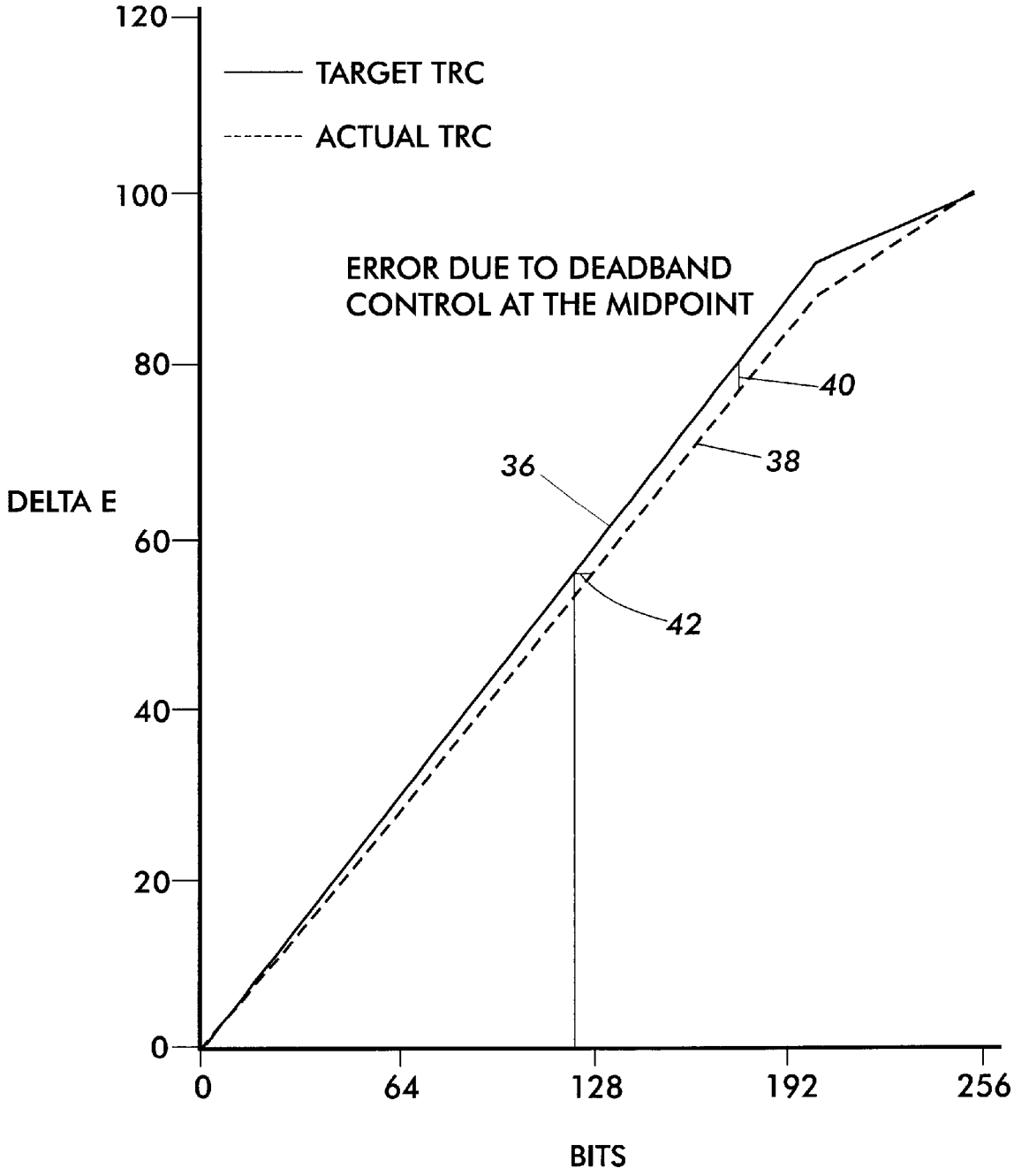
FIG. 3 illustrates actual TRC variation from a target TRC in terms of deltaE.

FIG. 3 illustrates actual TRC variation from the target TRC, due to error caused by dead band control at the midpoint and a method for reducing deltaE error caused by dead band control. Actual TRC 36 varies from target TRC 38 by an amount characterized as deltaE and shown as numeral 40 in FIG. 3. This error can be compensated for by printing a halftone density that is adjusted from the desired halftone density by a correction amount 42 such that the developed halftone density matches the requested halftone density. For example, an image might require a halftone density of 128 bits and, as shown in FIG. 3, reducing the requested 128 bits by correction factor 42 of 6 bits and printing a 122 bit density, results in a developed halftone equal to the original requested 128 bit halftone. Implementing the concepts disclosed herein results in halftone color print errors of about 3 $\text{deltaE}_{CMC\ 1.3:1}$ or less.

Figure 4:
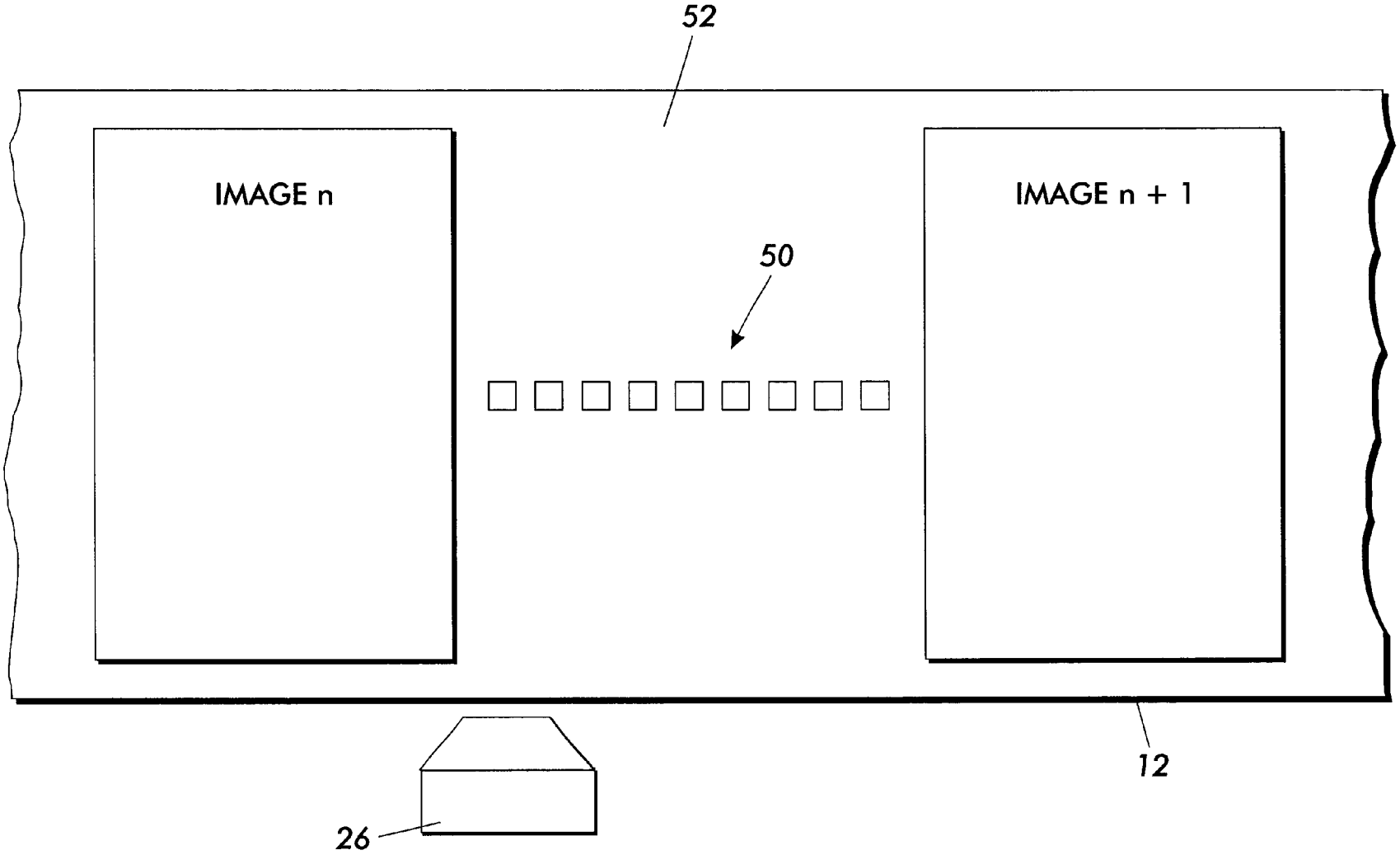
FIG. 4 shows a top view of the photoreceptor of FIG. 1 incorporating concepts of the present invention.

In accordance with the present invention, there is a process method that preferably uses an enhanced toner area coverage sensor to monitor the digital area coverage of halftone patches placed in the photoreceptor ID zone. FIG. 4 illustrates the basic process control method. An ETAC sensor 26 is used to monitor the digital area coverage (DAC) of halftone patches 50 placed in the inter-document zone 52 of the photoreceptor 12. It is to be appreciated that the arrangement of halftone patches 50 and ETAC sensor 26 as shown in FIG. 4 is provided as an aid to understanding concepts of the present invention and that other arrangements of halftone patches, with one or more sensors, including ETAC sensors or alternate types of sensors, are envisioned and fall within the scope of the present invention.

In one embodiment, nine halftone patches are printed in the inter-document zone in order to measure the TRC at nine points. The differences between the target TRC and the measured TRC at the nine points are calculated. The nine differences are fit using a three-term sine function in order to minimize the effects of noise. An adjustment is made to the look-up tables of the machines for the separations so the color printed remains consistent even though the underlying machine TRC may be changing. In order to minimize the effects of noise and to avoid customer perceptible print-to-print color variations, the LUT changes are kept small.

Figure 5:
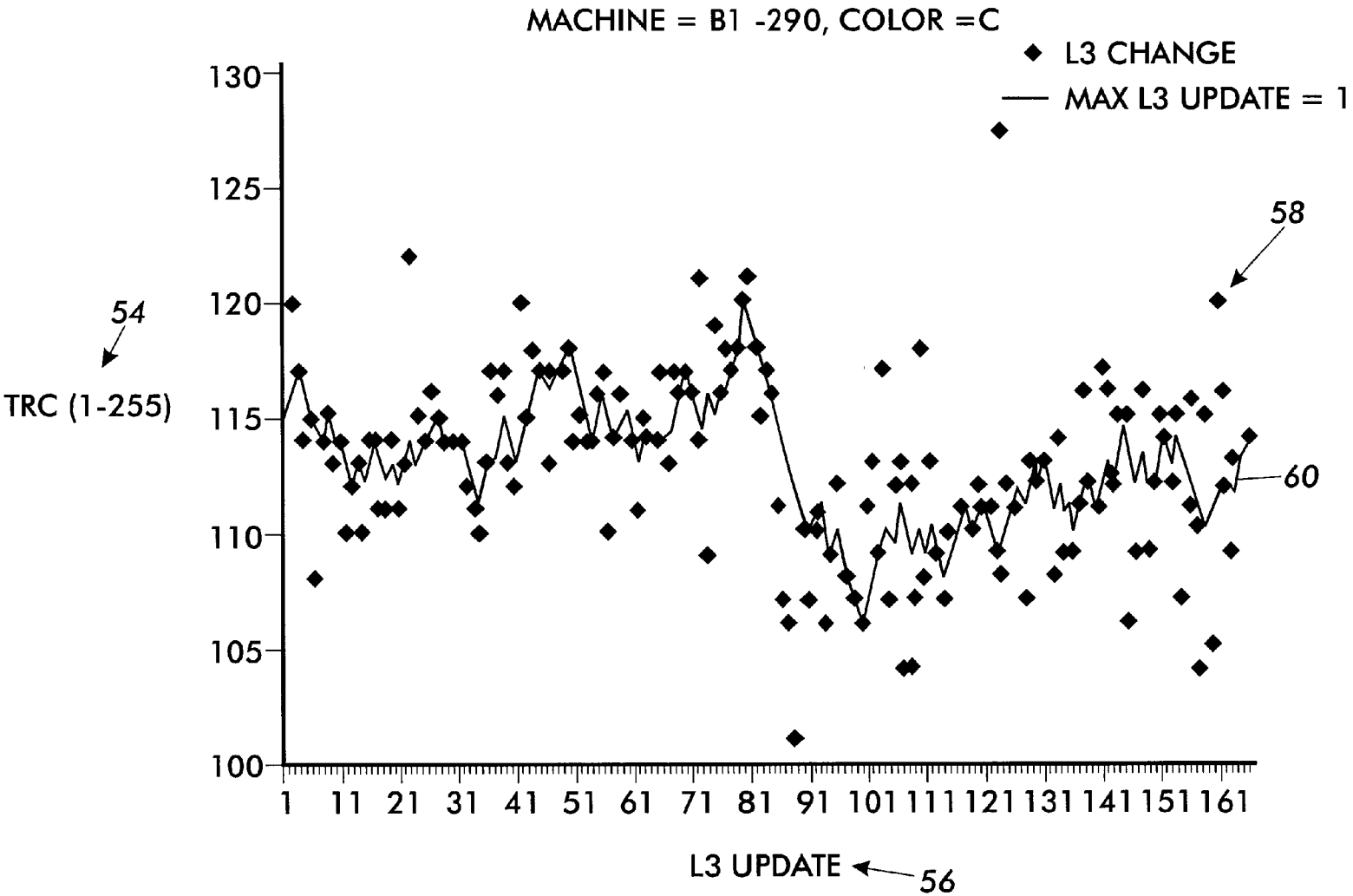
FIG. 5 illustrates exemplary TRC lookup table (LUT) updates for a 10,000 print run according to a preferred method of the present invention.

FIG. 5 illustrates exemplary TRC LUT updates for a 10,000 print run wherein the underlying machine TRC was changing, but the LUT updates were kept small in magnitude in order to avoid customer perceptible print-to-print color variations. It is assumed for the graph in FIG. 5 that the user is printing a halftone color value corresponding to 115 or, in other words, the input value for a LUT look-up was equal to 115. The vertical axis 54 represents the output value corresponding to a LUT input value of 115. The horizontal axis 56 corresponds to sequential TRC updates. The diamonds 58 show new output values that would be installed into the LUT after individual mid-tone test patch readings if no limits were otherwise in place. However, if a limit is placed on the magnitude by which the LUT can change on individual test patch readings, for example, a maximum change of ±1, solid line 60 shows the new output values that would be installed into the LUT after test patch samples. It can be seen from the graph that many of the diamonds represent noisy readings of the test patches, and limiting the maximum change of the LUT output values prevents the system from erroneously responding to individual noise patters. However, the solid line 60 follows the general trend of machine variations and keeps the TRC look-up table reasonably close to its correct output value with out introducing sudden jumps in response.

Figure 6:
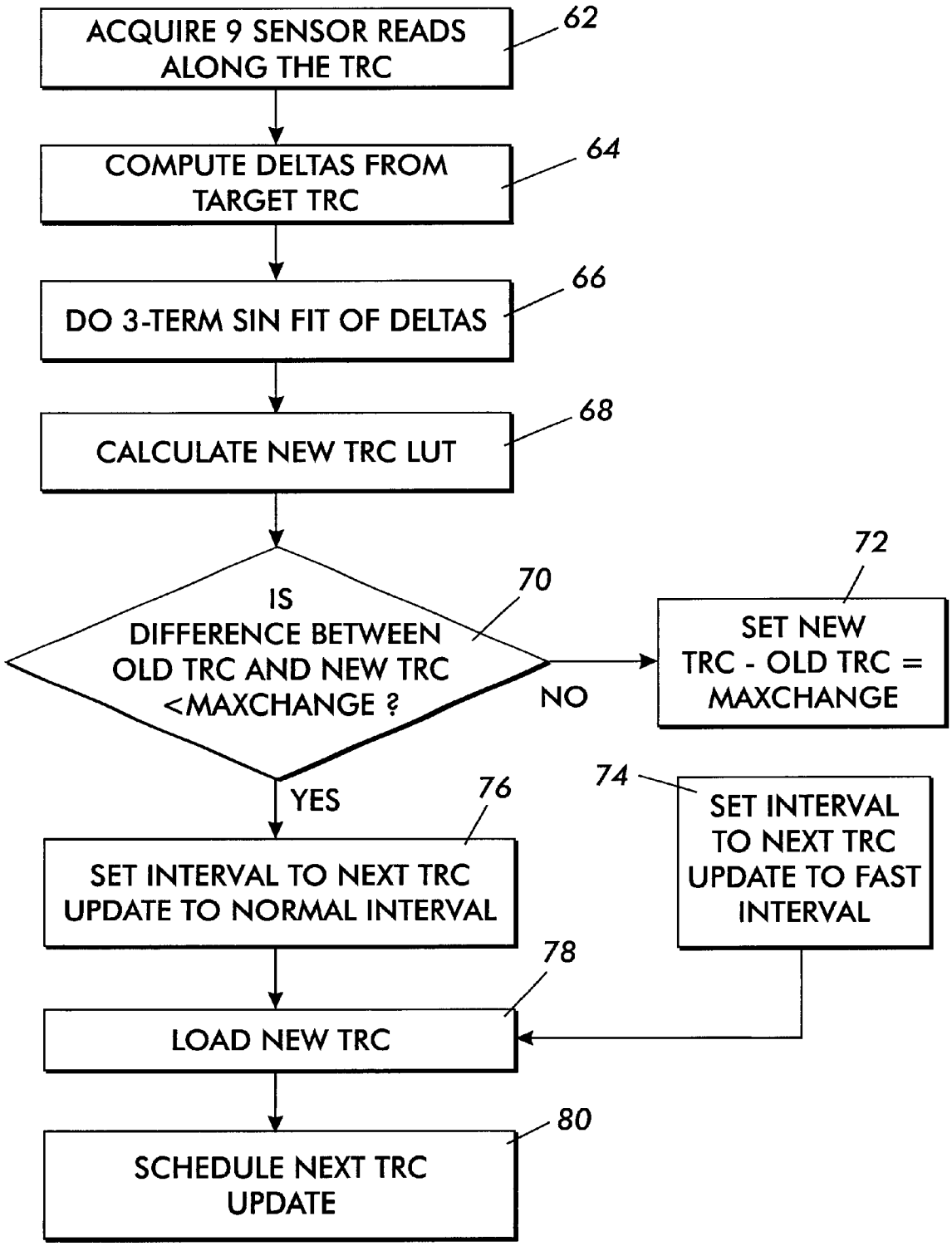
FIG. 6 is a flow diagram of a preferred method of the present invention.

FIG. 6 provides a flow chart illustrating steps of a method suitable for meeting objectives of the present invention. In step 62, nine patches 50, scheduled for printing and reading in the inter-document zone 52, are printed and sensor readings for the patches are acquired from the ETAC sensor, and the readings are stored in memory represented by a program variable, for example variable $\text{TRCRead}_{1\text{-}9}$. In step 64, deltas are computed based on the nine sensor readings and a target TRC value as in the following equation:

$$\Delta_{1\ldots 9}=\text{TRCRead}_{1\ldots 9}-\text{TRCTarget}_{1\ldots 9}$$

The deltas computed from the above equation are fit to a three-parameter sine model in step 66. A sine series is preferred as the model because it does not re-map the end points of the TRC. Although other series types may be suitable for use with the present invention, the three-term sine fit of a three-parameter sine model was shown to be sufficient. An advantage of the three-parameter sine model is the smoothing effect that it provides, thereby reducing undesirable sensitivity to noise in the sensor readings. The three-parameter sine model shown below is calculated by the following sets of equations wherein $DAC_i$ represents the Digital Area Coverage of patch i, which in an 8-bit system is the uncorrected TRC level for a respective patch divided by 255.

$$m=\sum_{i=1}^{9}\sin^2(\pi DAC_i)$$

$$n=\sum_{i}\sin(\pi DAC_i)\sin(2\pi DAC_i)$$

$$o=\sum_{i}\sin^2(2\pi DAC_i)$$

$$p=\sum_{i}\sin(\pi DAC_i)\sin(3\pi DAC_i)$$

$$q=\sum_{i}\sin(2\pi DAC_i)\sin(3\pi DAC_i)$$

$$r=\sum_{i}\sin^2(3\pi DAC_i)$$

$$u=pr-q^2$$

$$v=nr-oq$$

$$w=nq-op$$

$$x=no-mq$$

$$y=mr-o^2$$

$$z=mp-n^2$$

$$\text{denom}=mu-nv+ow$$

It should be noted that of the above terms, m-r, u-z and denom need to only be calculated once since they do not depend on test patch reading values. Terms a-c and A-C in the following equations, however, need to be calculated after each set of test patch readings.

$$a = \sum_i \Delta_i \sin(\pi DAC_i)$$

$$b = \sum_i \Delta_i \sin(2\pi DAC_i)$$

$$c = \sum_i \Delta_i \sin(3\pi DAC_i)$$

$$A = \frac{au - bv + cw}{denom}$$

$$B = \frac{-av + by + cx}{denom}$$

$$C = \frac{aw + bx + cz}{denom}$$

$$ModelDelta_{i=1\ldots 255} = A\sin\left(\frac{\pi i}{255}\right) + B\sin\left(\frac{2\pi i}{255}\right) + C\sin\left(\frac{3\pi i}{255}\right)$$

The fitted deltas resulting from the three-parameter sine model are stored in variable $ModelDelta_i$ and, in step 68, model TRC values are calculated by adding the fitted deltas to the target TRC values and storing the results in a model TRC. A candidate new TRC LUT is then computed based on a comparison of the model TRC with the target TRC.

In step 70, for each candidate new TRC LUT value, the difference between the previous TRC LUT value and the new TRC LUT value is compared to the predetermined maximum change value. If the difference is not less than the maximum change value, in step 72, the new individual TRC LUT value is adjusted so that it equals the original TRC LUT value ± the maximum change value. Preferably, in step 74, the patch test interval for the next TRC update is set to a predetermined fast interval. If, in step 70, it was determined that the difference is less than the maximum change value, then in step 76, the next TRC update is set to a normal interval. Processing now continues at step 78 where the new TRC replaces the current TRC and in step 80, the next TRC update is scheduled according to the interval determined in step 74 or step 76. A program for accomplishing steps 68–80 is provided below.

```
Calculate NewTRC (Step 68)
    ModelTRC = TRCTarget(1 . . . 255) + ModelDelta(1 . . . 255)
    j = 1
    For i = 1 to 254
        if j < 255 then
            while ModelTRC(j+1) < TRCTarget(i) increment j
        NewTRC(i) = j
        Next i
    NewTRC(255) = 255
FaultCheck NewTRC (Steps 70–76)
    FastUpdate = false
        For i = 1 to 255
            if NewTRC(i) − OldTRC(i) > MaxChange Then
                NewTRC(i) = OldTRC(i) + MaxChange
                FastUpdate = True
            Endif
        Next i
    Endif
UpdateTRC (Step 78)
    TRCUpdate = NewTRC
Schedule New Level 3 update (Step 80)
    if FastUpdate then Do next update in 100 prints
    else Do next update at normal interval
```

While the invention has been described with respect to specific embodiments by way of illustration, many modifications and changes will occur to those skilled in the art. It is therefore, to be understood that the appended claims are intended to cover all such modifications and changes which fall within the true spirit and scope of the invention.

What is claimed is:

1. A method for real-time control of a tone reproduction curve, the method comprising:

measuring a tone reproduction curve at a plurality of points, wherein the tone reproduction curve has end points comprising a first point and a last point;

computing differences of the measured tone reproduction curve from a target tone reproduction curve;

calculating model deltas by fitting the differences to a mathematical function wherein the end points remain fixed and the model deltas are computed using the mathematical function;

calculating a model tone reproduction curve by adding the model deltas to values from the target tone reproduction curve;

generating a new tone reproduction curve LUT by comparing the model tone reproduction curve to the target tone reproduction curve wherein the change in magnitude between each entry of the new tone reproduction curve LUT and a current tone reproduction curve LUT is limited to a predetermined maximum change value; and, replacing the current tone reproduction curve LUT with the new tone reproduction curve LUT.

2. The method according to claim 1 wherein the step of fitting the differences of the measured tone reproduction curve comprises fitting the differences to a three parameter sine model.

3. The method according to claim 1 wherein the step of measuring a tone reproduction curve at a plurality of points comprises measuring the tone reproduction curve at nine points.

4. The method according to claim 3 wherein the step of measuring a tone reproduction curve at nine points comprises:

printing nine test patches; and, measuring the nine test patches.

5. A method for real-time control of a tone reproduction curve, the method comprising:

measuring a tone reproduction curve at a plurality of points, wherein the tone reproduction curve has end points comprising a first point and a last point;

computing differences of the measured tone reproduction curve from a target tone reproduction curve;

calculating model deltas by fitting the differences to a mathematical function wherein the end points remain fixed and the model deltas are computed using the mathematical function;

calculating a model tone reproduction curve by adding the model deltas to values from the target tone reproduction curve;

generating a new tone reproduction curve LUT by comparing the model tone reproduction curve to the target tone reproduction curve;

setting an update interval to a predetermined normal value;

modifying the new tone reproduction curve LUT by performing, for each entry in the new tone reproduction curve LUT, the conditional steps of:

setting new tone reproduction curve LUT entry equal the current tone reproduction curve LUT entry plus the value of a predetermined maximum change value and setting an update interval variable to a predetermined fast value if the new tone reproduction curve LUT entry exceeds the current tone reproduction curve LUT entry by more than the predetermined maximum change value; and, setting new tone reproduction curve LUT entry equal the current tone reproduction curve LUT entry minus the value of a predetermined maximum change value and setting an update interval variable to a predetermined fast value if the current tone reproduction curve LUT entry exceeds the new tone reproduction curve LUT entry by more than the predetermined maximum change value;

replacing the current tone reproduction curve LUT with the new tone reproduction curve LUT; and, scheduling a tone reproduction curve update at a normal interval or a fast interval depending on the value of the update interval variable.

6. The method according to claim 5 wherein the step of fitting the differences of the measured tone reproduction curve comprises fitting the differences to a three parameter sine model.

7. The method according to claim 5 wherein the step of measuring a tone reproduction curve at a plurality of points comprises measuring the tone reproduction curve at nine points.

8. The method according to claim 7 wherein the step of measuring a tone reproduction curve at nine points test patches comprises:

printing nine test patches; and, measuring the nine test patches.

9. A printing system having real-time control of tone reproduction curves, the machine comprising:

a moving photoreceptor;

a means for storing a target tone reproduction curve; and, a means for updating a current tone reproduction curve LUT comprising:

a means for scheduling the depositing and measuring of the test patches;

a means for depositing halftone test patches on the photoreceptor;

a means for measuring the density of the halftone test patches and generating a measured tone reproduction curve;

a means for computing differences between the measured tone reproduction curve and the target tone reproduction curve;

a means for fitting the differences to a mathematical function;

a means for calculating a new tone reproduction curve LUT based on the target tone reproduction curve and the fitted differences, including a means for limiting differences between the new tone reproduction curve LUT and a current tone reproduction curve LUT to a predetermined maximum magnitude, wherein endpoints of the new tone reproduction curve LUT equal endpoints of the current tone reproduction curve LUT; and, a means for loading the current tone reproduction curve LUT with the new tone reproduction curve LUT.

10. The printing system according to claim 9 further including:

a means for scheduling the depositing and measuring of the test patches at a fast interval if at least one difference between the new tone reproduction curve LUT and the current tone reproduction curve LUT exceeded a predetermined maximum magnitude; and, a means for scheduling the depositing and measuring of the test patches at a normal interval if none of the differences between the new tone reproduction curve LUT and the current tone reproduction curve LUT exceeded a predetermined maximum magnitude.

11. The printing system according to claim 10 wherein the means for measuring comprises a densitometer.

12. The printing system according to claim 10 wherein the means for depositing, deposits nine halftone test patches.

13. The printing system according to claim 10 wherein the means for fitting fits the differences to a sine function.

14. The printing system according to claim 13 wherein the means for fitting fits the differences to a three parameter sine function.

15. The printing system according to claim 9 wherein the printing system comprises an electrophotographic machine.

16. The printing system according to claim 15 wherein the halftone patches comprise deposited toner.

17. The printing system according to claim 9 wherein the printing system comprises an inkjet machine.

18. The printing system according to claim 17 wherein the halftone patches comprise deposited ink.

* * * * *